United States Patent [19]

Ishii et al.

[11] 4,391,193

[45] Jul. 5, 1983

[54] PLATE HOLDING DEVICE FOR OFFSET DUPLICATOR

[75] Inventors: Koji Ishii; Takahiko Shinmoto, both of Fuchu; Kenso Maehara, Hiroshima, all of Japan

[73] Assignee: Ryobi Ltd., Hiroshima, Japan

[21] Appl. No.: 251,450

[22] Filed: Apr. 6, 1981

[30] Foreign Application Priority Data

Apr. 17, 1980 [JP] Japan ..... 55-52663

[51] Int. Cl.[3] ..... B41F 27/00

[52] U.S. Cl. ..... 101/415.1; 101/141; 101/142; 101/144

[58] Field of Search ..... 101/415.1, DIG. 12, 101/141, 142, 144

[56] References Cited

U.S. PATENT DOCUMENTS 3,425,348 2/1969 Hermach et al. ..... 101/415.1
3,557,695 1/1971 Preuss ..... 101/415.1
3,559,575 2/1971 Magrath ..... 101/415.1
3,685,445 8/1972 Muselik ..... 101/415.1
3,858,512 1/1975 Simeth ..... 101/415.1

*Primary Examiner*—Edgar S. Burr
*Assistant Examiner*—Bradley M. Lewis
*Attorney, Agent, or Firm*—Sughrue, Mion, Zinn, Macpeak and Seas

[57] ABSTRACT

A printing plate holding device for an offset duplicator. The device includes a base slidably positioned on one side of a grooved portion of a plate cylinder of the duplicator. A clamp plate is secured to the base and a clamp lever is attached to the clamp plate. A latch is loosely secured to a pin attached to the clamp lever and connected to a spring to provide a plate clamping force upon the clamp plate. A guide plate and a plate release preventing plate are attached to an outer longitudinal side of the base. An axial displacement control device is positioned at one longitudinal end of the cylinder while a circumferential displacement control device is positioned at the other longitudinal end thereof.

9 Claims, 6 Drawing Figures

PLATE HOLDING DEVICE FOR OFFSET DUPLICATOR

BACKGROUND OF THE INVENTION

The present invention relates to a printing plate holding device for use in an offset duplicator.

A number of types of printing plate holding devices have been previously proposed and put into practice. With any of these, when employing a straight printing plate formed with no perforations, control of distortion or lateral displacement of the plate cannot be carried out so that displacement tends to occur at the tail edge of the plate during printing operations, even if the plate has been accurately formed. Upon displacement of the plate, the printed image is distorted.

It is thus an object of the invention to overcome the drawbacks attendant to the conventional device. A specific object of the invention is to provide a plate holding device capable of employing both aluminum and paper plates as well as being capable of employing perforated and straight (non-perforated) plates and which can adequately control distortion and lateral sliding of a non-perforated plate.

SUMMARY OF THE INVENTION

In accordance with these and other objects of the invention, there is provided a printing plate holding device for use with an offset duplicator with the holding device being positioned in a grooved portion of the plate cylinder of the duplicator confronting a tail clamp device. The holding device includes a base positioned along one side of the grooved portion and rotatably secured thereto in a horizontal plane. A clamp plate is pivotably secured to the base and provided with a first pin. A clamp lever is fixed to the clamp plate and is provided with a second pin. A latch is loosely secured to the first pin of the clamp lever and is connected to a spring in such a manner as to provide a plate clamping force against the clamp plate. The latch is engageable with a bracket of the base so as to maintain the clamp plate at an open position. A guide plate and a plate release preventing plate are fixed to an outer longitudinal side of the base. Axial displacement control means is positioned at one longitudinal end of the cylinder while circumferential displacement control means is positioned at the other longitudinal end thereof. The axial displacement control means includes a first knob rotatably extending through a slot formed in a first bracket fixed to the base with the first knob being directly or indirectly threadingly engaged with the plate cylinder. The circumferential displacement control means includes a secod knob rotatably extending through a slot formed in a second bracket attached to the plate cylinder with the second knob being threadingly engaged with a third bracket fixed to the base.

DESCRIPTION OF THE PREFERRED EMBODIMENTS

Figure 1:
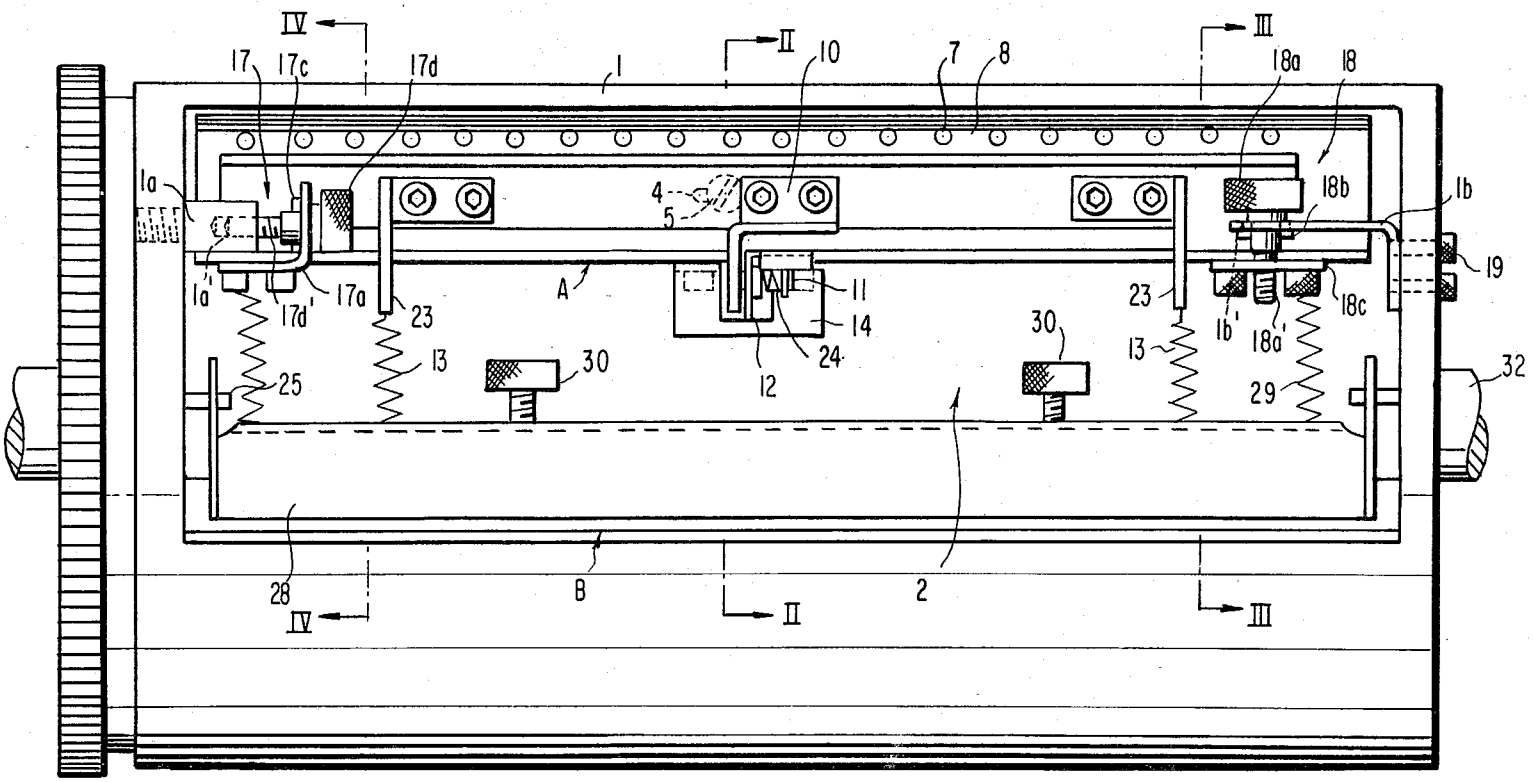
FIG. 1 shows a front view of a preferred embodiment of a plate holding device of an offset duplicator according to the invention.

A preferred embodiment of the invention will be described with reference to the drawings. With reference to FIGS. 1 through 6, a plate cylinder 1 is formed with a groove portion 2 in which a plate holding device A is disposed confronting a tail clamp device B. The structure of the plate holding device A includes a groove portion 2 having one longitudinal side provided with a slide base 1*e* (FIG. 6) on which a base 3 is slidably mounted in a horizontal plane. The base 3 is formed with a slot 4 at approximately the longitudinal center thereof through which a pin 5 extends to loosely secure the base 3 to the slide base 1*e*. The base 3 has an outer longitudinal side on the upper surface thereof against which a printing plate 6 is secured. The base 3 has an inner longitudinal side to which one end of a hinge 9 is secured. The other end of the hinge 9 is connected with a clamp plate 8 provided with a pin 7 so that the clamp plate 8 is pivotally mounted with respect to the base 3. The clamp plate 8 is connected to a clamp lever 10 integrally provided with a pin 11 (FIG. 6) with which a latch 12 is loosely secured. The clamp plate 8 is urged toward the outer longitudinal side of the base 3 by a spring 13 so as to provide a printing plate clamping force.

A bracket 14 is secured to the base 3 so as to interlock the latch 12 therewith to maintain the latched position when the clamp plate 8 is in the open position thereof. Further, at the other longitudinal side of the base 3, a guide plate 15 and a plate release preventing plate 16 are fixedly secured. The plates 15 and 16 project from the upper surface of the base 3 to a suitable length. The plate cylinder 1 is at one longitudinal end provided with an axial displacement control device 17 and at the other end is provided with a circumferential displacement control device 18.

Figure 4:
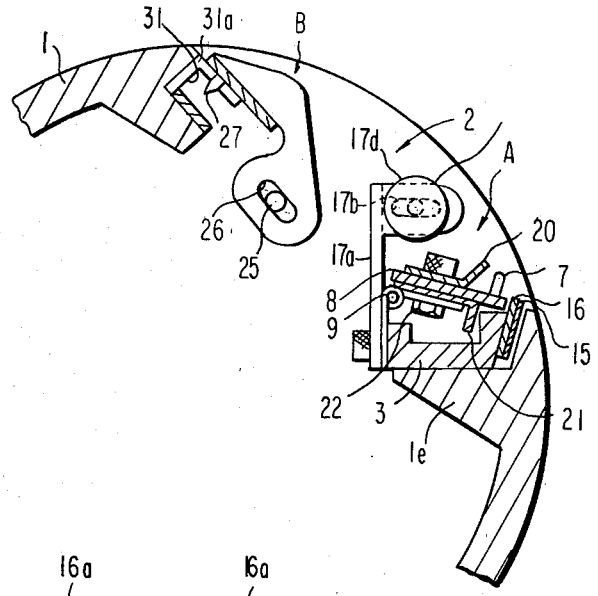

As shown in FIGS. 1 and 4, the axial displacement control device 17 includes a bracket 17*a* connected to the inner longitudinal side of the base 3. The bracket 17*a* is formed with a slot 17*b* oriented perpendicular to the axial direction of the plate cylinder 1. A knob 17*d* extending parallel to the axial direction of the cylinder 1 extends through the slot 17*b*. The knob 17*d* is rotatably secured to the bracket 17*a* by a pin 17*c* and a thread portion 17*d*' thereof can be directly engaged with the plate cylinder 1. Alternatively, as shown, the thread portion 17*d*' can be engaged with a female thread 1*a*' of a bracket 1*a* fixed to the cylinder 1. Upon manual rotation of the knob 17*d* causing movement of the thread portion 17*d*', the base 3 which secures the printing plate 6 is slidably moved on the slide base in the axial direction of the cylinder within the effective length of the slot 4 formed in the base 3. The printing plate is then moved in its lateral direction.

Figure 3:
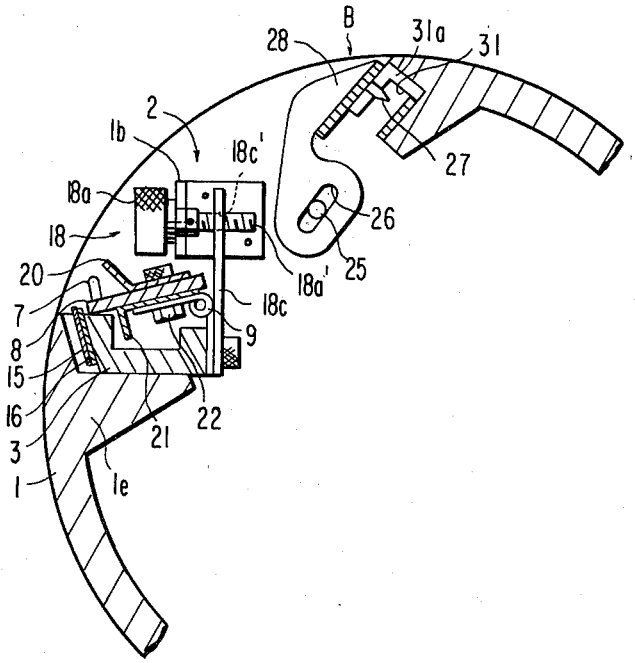

As shown in FIGS. 1 and 3, the circumferential displacement control device 18 includes a bracket 1*b* which extends in the axial direction of the cylinder 1 and which is connected to the cylinder 1 by bolts 19. The bracket 1*b* is formed with a slot 1*b*' extending parallel to the axis of the cylinder. A knob 18*a* extends through the slot 1*b*' and is rotatably secured to the bracket 1*b* by a pin 18*b*. The knob 18*a* has a thread portion 18*a*' threadingly engageable with a female thread 18*c*' formed in a bracket 18*c* secured to the inner longitudinal side of the base 3. By the movement of the knob 18*a* relative to the bracket 18*c*, the base 3 is rotated about the pin 5 extending through the slot 4 to thus provide position control of the printing plate 6 in the circumferential direction of the cylinder.

To the clamp plate 8 is secured a guide plate 20 and a printing plate abutment 21 by a nut 22 at the upper and lower surfaces thereof, respectively. The clamp plate 8 further secures an arm 23 to which one end of the spring 13 is secured. The other end of the spring 13 is secured to a stud 1*c* of the plate cylinder 1 so that the clamp plate 8 provides a printing plate clamping force. The latch 12 rotatably secured to the pin 11 is provided with a torsion spring 24 which urges a recessed portion 12*a* toward the interlocking position with the bracket 14 whereby the clamp plate 3 is maintained in the open position by the interlock between the recess 12*a* and the bracket 14 as shown in FIG. 6.

Figure 5:
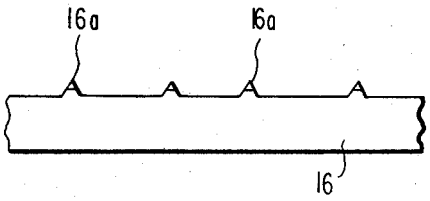
FIG. 5 is a front view showing a plate release preventing plate of the device of FIG. 1.

Further, as shown in FIG. 5, the plate release preventing plate 16 is provided with a plurality of thrust pawls 16*a* each projecting outwardly a fixed distance. The thrust pawls 16*a* serve to prevent the printing plate interposed between the base 3 and the clamp plate 8 from being released therefrom due to the thrusting engagement between the pawls and the plate.

Figure 2:
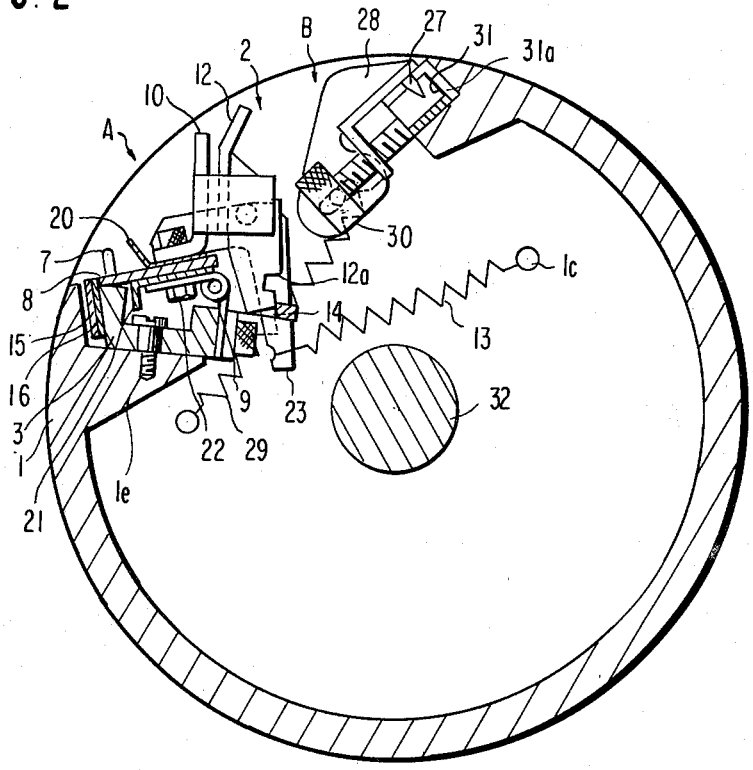
FIGS. 2, 3, 4 are cross-sectional views as viewed along lines II—II, III—III, and IV—IV in FIG. 1 respectively.

The tail clamp device B serves to clamp the tail end of the printing plate to the plate cylinder. The structure of this device is well known in the art. As shown in FIGS. 2 and 4, a tail clamp 28 provided with a pin 27 is slidably secured to the cylinder 1 due to the engagement between pins 25 extending from the cylinder and slots formed in the clamp 28. The tail clamp 28 is urged toward the inner longitudinal side of the base by the biasing force of a spring 29. A control screw 30, which is screwed with the clamp 28, has a tip end in abutment with a tail clamp base 31 fixed to the plate cylinder 1. Accordingly, the tail end of the printing plate is interposed between the tail clamp base 31 and the tail clamp 28 provided with pin 27. Upon attachment of the tail end of the printing plate, the tension imposed on the plate is adjustable by movement of the control screw 30. The tail clamp base 28 is formed with a recess 31*a* for allowing movement of the pin 27. In FIGS. 1 and 2, reference numeral 32 designates a shaft of the plate cylinder.

Figure 6:
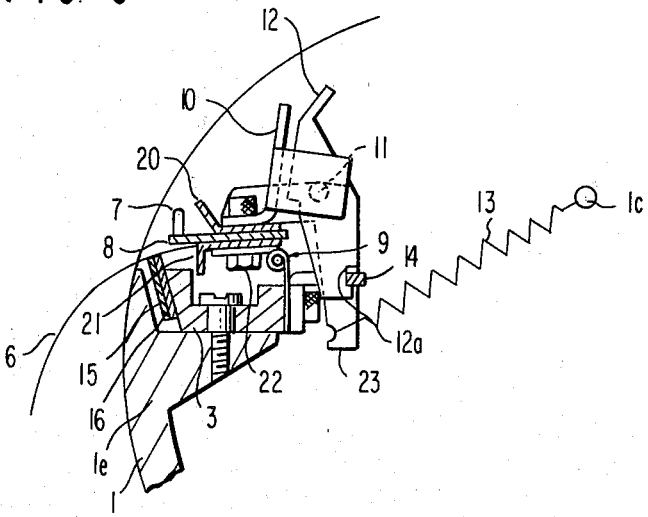
FIG. 6 is a cross-sectional view of the device of FIG. 1 showing an open position of a clamp plate.

With this structure, to attach a printing plate, as shown in FIG. 2, the clamp lever 10 is rotated about the hinge 9 against the biasing force of the spring 13 whereupon the clamp plate 8 is opened with respect to the base 3 as shown in FIG. 6. In this case, the recessed portion 12*a* of the latch 12 is brought into locking engagement with the bracket 14 so that the clamp plate 8 is maintained at its open position.

The tail portion of the printing plate is previously clamped by the tail clamp device B. In this state, the leading edge of the printing plate 6 is inserted between the base 3 and the clamp plate 8 wrapping around the outer peripheral surface of the plate cylinder 1 as shown in FIG. 6. Thereafter, upon pressing the top end of the latch 12 toward the right in the drawing, the latch 12 is disengaged from the bracket 14 so that the clamp plate 8 is closed by the biasing force of the spring 13 via the arm 23 to thereby fixedly secure the leading edge of the printing plate between the clamp plate 8 and the base 3. In this case, the thrust pawls 16*a* of the plate release preventing plate 16 press against the plate 6 and therefore the plate thus secured is fixedly clamped.

If the plate thus clamped is displaced, any such displacement can be eliminated by the circumferential displacement control device 18 while maintaining the plate clamped. That is, by manual rotation of the knob 18*a* secured to the bracket 1*b* extending in the axial direction of the cylinder, the bracket 18*c* is moved to rotate the base 3 about pin 5 whereby the circumferential position of the printing plate 6 is controlled.

Further, axial displacement of the plate 6 relative to the plate cylinder 1 can be corrected by the axial displacement control device 17. That is, by the movement of the knob 17*d* relative to the bracket 1*a* of the plate cylinder 1, the base 3 slides along axial direction of the cylinder within the range of axial length of the slot 4. Therefore, the axial position of the printing plate 6 can be controlled.

It is to be noted that since the knobs 17*d* and 18*a* of the respective devices 17 and 18 are merely inserted into the slots 17*b* and 1*b*' formed in the brackets 17*a* and 1*b*, respectively, the knobs do not present obstacles for which could prevent axial and circumferential sliding movements of the base 3.

As described above, according to the plate holding device A of the present invention, the clamp plate 8 is pivotally secured to the outer longitudinal side of the base 3 with the plate release preventing plate 16 being fixed thereto and the base 3 is rotatably secured in a horizontal plane to the plate cylinder 1. Further, one longitudinal end of the cylinder is provided with the axial displacement control device 17 while the other longitudinal end is provided with the circumferential displacement control device 18. With the above-described construction, during printing plate clamping, the plate release preventing plate 16 thrusts into the printing plate so that plate release is prevented by the spring 13 which provides a clamping force. Simultaneously, lateral displacement of the printing plate 6 can be controlled by the axial displacement control device 17 and the circumferential displacement control device 18 while maintaining the clamping of the plate 6 between the base 3 and the clamp plate 8 so that distortion or twisting of the image can be eliminated during printing operations to thus enhance the printing efficiency. Furthermore, displacement control can be easily carried out by merely rotating the knobs 18*a* and 17*d* without employing any special tool or requiring any special skill. Moreover, the device of the invention can be used with perforated or non-perforated printing plates as well as aluminum plates or sheet plates.

What is claimed is:

1. A printing plate holding device for an offset duplicator, said holding device being positioned in a grooved portion of a plate cylinder and confronting a tail clamp device, said holding device comprising: a base positioned along one side of said grooved portion and slidably secured thereto in a horizontal plane; a clamp plate pivotally secured to said base and provided with a first pin; a clamp lever fixed to said clamp plate and provided with a second pin; a latch loosely secured to said second pin of said clamp lever and connected to a spring so as to provide a plate clamping force to said clamp plate, said latch being engageable with a bracket of said base so as to maintain said clamp plate at an open position; a guide plate and a plate release preventing plate both fixed to an outer longitudinal side of said base; axial displacement control means positioned at one longitudinal end of said cylinder; circumferential displacement control means positioned at the other longitudinal end of said cylinder; said axial displacement control means comprising a first knob rotatably extending through a slot formed in a first bracket fixed to said base, said first knob being threadingly engaged with said plate cylinder; and said circumferential displacement control means comprising a second knob rotatably extending through a slot formed in a second bracket fixed to said cylinder, said second knob being threadingly engaged with a third bracket fixed to said base.

2. The printing plate holding device of claim 1 wherein said plate cylinder comprises a slide base portion extending inwardly from an outer surface of said plate cylinder and wherein said base has a slot formed at approximately its longitudinal center, and further comprising a third pin for loosely securing said base portion to said slide base, said third pin extending through said slot.

3. The printing plate holding device of claim 1 wherein said slot formed in said first bracket extends substantially perpendicular to the axial direction of said plate cylinder.

4. The printing plate holding device of claim 3 wherein said first knob is threadingly engaged with said plate cylinder.

5. The printing plate holding device of claim 3 wherein said first knob is engaged with said plate cylinder through a fourth bracket.

6. The printing plate holding device of claim 1 wherein said slot in said second bracket extends parallel to the axis of said plate cylinder.

7. The printing plate holding device of claim 1 wherein said plate release preventing plate is provided with a plurality of thrust pawls projecting outwardly for securing a printing plate.

8. The printing plate holding device of claim 1 further comprising a second guide plate and a printing plate abutment, said second guide plate and said printing plate abutment being secured, respectively, to upper and lower surfaces of said clamp plate.

9. The printing plate holding device of claim 1 further comprising a torsion spring for urging a recessed portion of said latch toward an interlocking position with said bracket of said base.

* * * * *